US006402015B1

(12) United States Patent
Collins

(10) Patent No.: US 6,402,015 B1
(45) Date of Patent: Jun. 11, 2002

(54) ENVELOPE HAVING DUAL FUNCTION ADHESIVE

(75) Inventor: Robert W. Collins, Shawnee, KS (US)

(73) Assignee: Winkeler + Dunnebrier, AG (DE)

( * ) Notice: Subject to any disclaimer, the term of this patent is extended or adjusted under 35 U.S.C. 154(b) by 0 days.

(21) Appl. No.: 09/851,075

(22) Filed: May 8, 2001

(51) Int. Cl.[7] ..... B65D 27/00
(52) U.S. Cl. ..... 229/74; 229/80
(58) Field of Search ..... 229/74, 80, 80.5, 229/81, 82, 928; 383/211, 86, 84, 89, 90, 2; 206/813

(56) References Cited

U.S. PATENT DOCUMENTS

| | | | | | |
|---|---|---|---|---|---|
| 1,800,143 | A | * | 4/1931 | Hughes | 229/80 |
| RE19,934 | E | * | 4/1936 | Kennedy, Jr. | 229/80 |
| 2,051,711 | A | * | 8/1936 | Heywood | 229/80 |
| 2,329,055 | A | * | 9/1943 | Kegan | 229/80 |
| 2,944,470 | A | | 7/1960 | Doetsch | |
| 2,988,969 | A | | 6/1961 | Stratton et al. | |
| 3,327,416 | A | * | 6/1967 | Sanford | 229/74 |
| 3,400,642 | A | | 9/1968 | Stemmler | |
| 3,630,125 | A | | 12/1971 | Helm | |
| 3,733,982 | A | | 5/1973 | Manolis | |
| 3,799,044 | A | | 3/1974 | Manolis | |
| 3,906,844 | A | | 9/1975 | Gougeon | |
| 4,103,821 | A | * | 8/1978 | Gartshore et al. | 229/74 |
| 4,134,322 | A | | 1/1979 | Lillibridge | |
| 4,443,211 | A | | 4/1984 | Wooley | |
| 4,579,277 | A | * | 4/1986 | Gendron | 229/74 |
| 4,738,391 | A | * | 4/1988 | Wiseman | 229/80 |
| 5,044,776 | A | * | 9/1991 | Schramer et al. | 383/89 |
| 5,049,118 | A | | 9/1991 | McNabb | |
| 5,397,427 | A | | 3/1995 | Traise et al. | |
| 5,540,806 | A | | 7/1996 | Traise | |
| 5,641,318 | A | | 6/1997 | Vetter | |
| 5,776,285 | A | | 7/1998 | Blümle | |
| 5,937,615 | A | | 8/1999 | Forman | |

* cited by examiner

*Primary Examiner*—Stephen P. Garbe
(74) *Attorney, Agent, or Firm*—Shook, Hardy & Bacon L.L.P.

(57) ABSTRACT

A self-sealing envelope having an adhesive assembly positioned in such a manner so as to both adhesively secure the seal flap and adhere the envelope to another surface. When the seal flap of the envelope is in its closed position, the seal flap is received by, and only partially covers, a first portion of the adhesive assembly, with a second portion of the adhesive assembly remaining exposed. This first portion of the adhesive receives and seals the closed seal flap. The exposed second portion of the adhesive assembly is adapted to adhesively receive a surface, such as a package, another envelope, or other suitable surface, thereby retaining the envelope on such surface.

7 Claims, 1 Drawing Sheet

ENVELOPE HAVING DUAL FUNCTION ADHESIVE

CROSS-REFERENCE TO RELATED APPLICATIONS

None.

FIELD OF THE INVENTION

The present invention relates in general to envelopes, and more specifically, to envelopes having self-sealing characteristics. In particular, this invention relates to self-sealing envelopes employing adhesive assemblies including pressure sensitive adhesives with removable protective covers.

BACKGROUND OF THE INVENTION

Over the years, envelopes have been made utilizing any of a number of different mechanisms for performing the sealing function. In the past, the typical method of sealing envelopes was the use of a remoistenable strip of glue positioned along the edge of the envelope flap. More recently, this remoistenable glue strip has been replaced by adhesives which do not require moistening for use. One example of such an adhesive more recently being employed is a pressure sensitive adhesive which is positioned on either the envelope seal flap or the back flap of the envelope. Prior to use, such a pressure sensitive adhesive is typically covered with a protective strip made of a release-type material, with the protective strip being removable to expose the underlying adhesive immediately prior to sealing the envelope.

Such envelopes can be employed for any of a number of different uses, including business and personal uses. There are circumstances with any of these uses when it may be desired by the user to adhere the envelope to a surface, such as a package or other envelope. In the past, this has been accomplished primarily by one of two different means, namely, the use of a length of tape to affix the envelope to a package or other surface, or the use of a glue or other form of moist adhesive to similarly affix the envelope. Both-of-these -methods have drawbacks. First, both conventional methods require that the user employ an additional, and sometimes costly item, namely a roll of tape, bottle of glue, or other adhesive. This additional item may not be readily available to the user at the time it is needed to affix the envelope to the package or other surface, creating an undesirable inconvenience for the user. Second, conventional adhesives can be awkward or messy to use, often creating a situation requiring clean-up of excess tape (which can be stuck together, or which can lose its adhesive properties if, for example, it is not precisely placed by the user on the first try), glue (which can spill or spread over undesirable portions of the surface) or other moist adhesive. Finally, the user must spend additional time obtaining and applying the separate tape, glue or other adhesive, and must often also spend additional time cleaning up any mess which may have been caused by the use of such separate adhesive means.

Accordingly, the present invention provides a self-sealing envelope which is capable of being affixed to a surface such as a package or the like, without the need for any separate adhesive means, so that the user saves time and money in accomplishing his or her task. Further, the present invention can help to eliminate unwanted mess associated with other types of adhesives.

SUMMARY OF THE INVENTION

The present invention comprises a self-sealing envelope having means for adhering to another surface. This means comprises a single adhesive assembly, such as one having a pressure sensitive adhesive with a removable protective cover layer positioned thereover. The adhesive assembly is positioned on the envelope so as to receive an edge of the envelope flap over only a portion of the adhesive assembly when the flap is in a closed position, the remainder of the adhesive assembly remaining exposed and being adapted to be adhesively affixed to another surface.

According to one embodiment of the present invention, an envelope is disclosed having means for sealing itself, the envelope comprising a pouch defined by front and rear panels, the pouch including an opening; a seal flap extending from the front panel, the seal flap being foldable about a fold line from an open position in which the opening is accessible and the back panel is uncovered to a closed position in which the seal flap blocks the opening and overlies a portion of the back panel; and a length of an adhesive assembly situated on the back panel and including a corresponding length of an adhesive, the adhesive assembly being positioned so that when the seal flap is in the closed position, the seal flap covers a first portion of the adhesive assembly, with a second portion of the adhesive assembly remaining exposed; wherein a first portion of the adhesive receives and seals the seal flap in the closed position, and a second portion of the adhesive remains exposed when the seal flap is in the closed position, the second portion of the adhesive being capable of adhering the envelope to another surface.

According to another embodiment of the present invention, the adhesive is a pressure sensitive adhesive tape having a length of a removable protective strip selectively positioned over the adhesive, the adhesive being exposed upon removal of the protective strip. The adhesive has a defined perimeter, and in one embodiment, the removable protective strip extends beyond at least a portion of the perimeter of the adhesive. According to an alternative embodiment, the adhesive of the adhesive assembly comprises a remoistenable glue strip.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
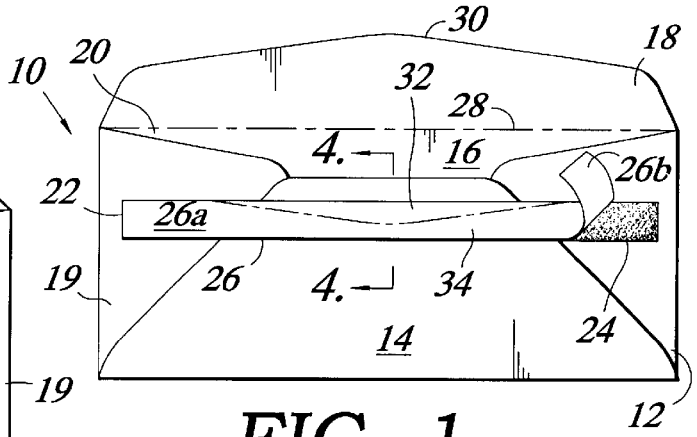
FIG. 1 is a back plan view of the self-sealing envelope of the present invention showing the adhesive assembly with the protective layer partially removed, and with the flap in its open position.
Figure 2:
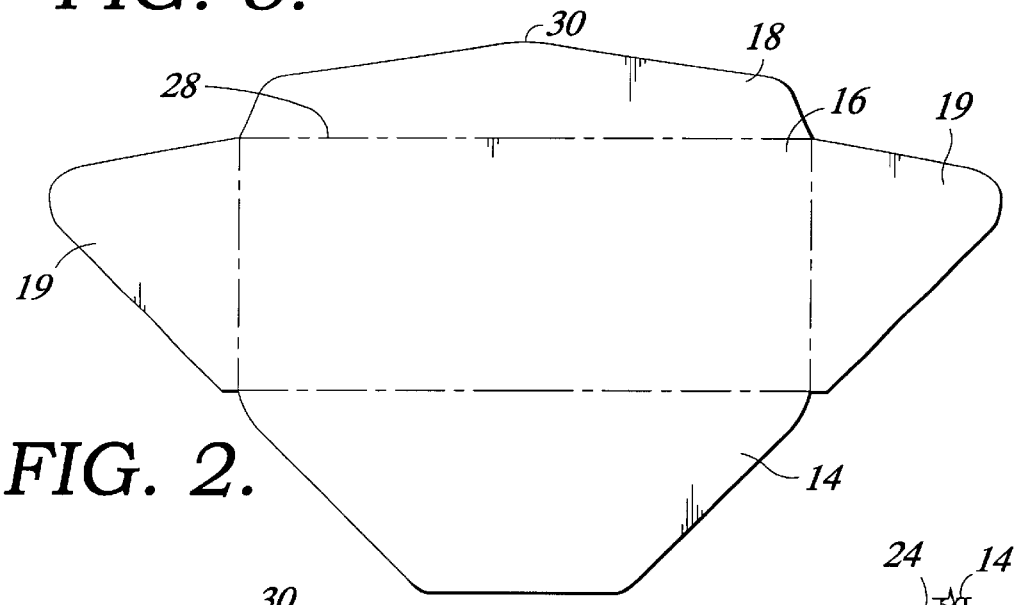
FIG. 2 is a plan view of an envelope blank for forming the self-sealing envelope of FIG. 1.

Referring now to the drawing depicted in FIG. 1, a self-sealing envelope is generally referred to by the numeral 10. This envelope 10 comprises a pouch 12 for receiving the contents of the envelope, which can be any of a number of objects, such as sheets of paper, packing lists, greeting cards, or the like. This pouch 12 is defined by back panel 14 and front panel 16, as can be seen in FIG. 1 and in the envelope blank depicted in FIG. 2. Extending from front panel 16 is a seal flap 18, the seal flap 18 being adapted to fold from an open position in which an opening 20 of the pouch 12 is accessible and the back panel 14 is uncovered, to a closed position in which the flap blocks the opening 20 of the pouch 12 and overlies a portion of the back panel 14. Side flaps 19 are adapted to be folded inwardly toward the front panel 16 to complete the formation of the pouch 12. The seal flap 18 has a flap edge portion 30, and is shown in the drawings as being a somewhat curved, elongated v-shaped flap, but as will be understood by those skilled in the art, can be of any suitable shape. Similarly, as is apparent from reference to FIGS. 2 and 5, back flap 14 and side flaps 19 can be of any suitable shape, and are not limited to the specific shapes depicted in the FIGS.

The envelope 10 described herein is only one of a number of suitable envelopes, as will be appreciated by those skilled in the art. The envelope 10 as depicted can, for example, be formed from a blank as in FIG. 2, which is folded to form the various portions of the envelope which are described herein, or can be formed from a differently shaped blank as in FIG. 5. Any other suitable conventional methods of manufacture can also be used to make envelopes in accordance with this invention. The particular method of manufacture of the envelope and its adhesive assembly is not particularly relevant to the present invention.

Figure 5:
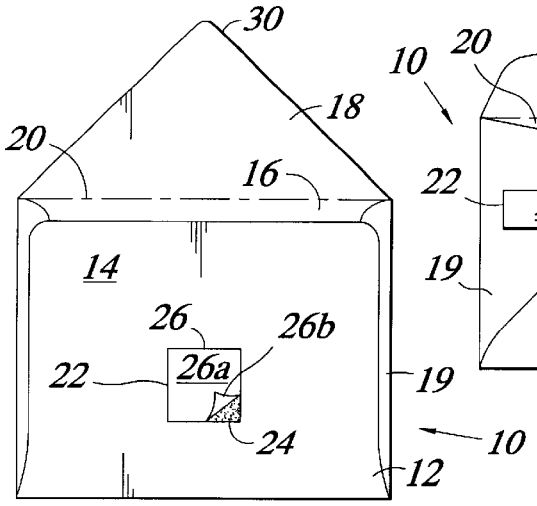
FIG. 5 is a back plan view of an alternative embodiment of the self-sealing envelope of the present invention, showing the adhesive assembly with the protective layer partially removed, and with the envelope seal flap in its open position.
Figure 4:
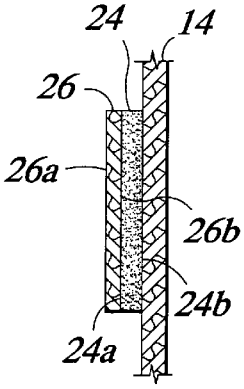
FIG. 4 is a fragmentary, enlarged cross-sectional view taken along the line 4—4 of FIG. 1, showing the adhesive assembly of the present invention.

Positioned on the back panel 14 of the envelope 10 is an adhesive assembly 22. Referring in more detail to FIGS. 1, 4 and 5, in one embodiment of the present invention, the adhesive assembly 22 comprises a length of adhesive 24 having a top face 24*a* and a bottom face 24*b*. Typically, both the adhesive top face 24*a* and the adhesive bottom face 24*b* have adhesive surfaces, wherein the adhesive 24 is secured to the back panel 14 of the envelope 10 by the adhesive bottom face 24*b*. As an example, adhesive 24 can take the form of a double-sided, pressure sensitive adhesive tape, or can be a rolled on adhesive. Also provided as part of the adhesive assembly 22 is a corresponding length of a removable protective strip 26 having a top face 26*a* and a bottom face 26*b*. The protective strip bottom face 26*b* releasably adheres to and covers the adhesive top face 24*a*. Both faces 26*a* and 26*b* of the protective strip are non-adhesive, and are formed with release-type materials such as silicone or other well-known materials, although it is understood that it can be made of any suitable material known to those skilled in the art. When the adhesive assembly 22 is intact, the only exposed portion of the adhesive assembly 22 is the non-adhesive protective strip top face 26*a*. While not essential, it may be desirable for the dimensions of the protective strip 26 to be somewhat larger than the dimensions of the adhesive 24, so as to facilitate removal of the protective strip by the user.

In an alternative embodiment of the present invention, the adhesive assembly 22 comprises a remoistenable adhesive applied to the back panel 14 of the envelope 10. Such a remoistenable adhesive would not require the utilization of a non-adhesive protective strip.

When positioning the adhesive assembly 22 on the back panel 14 of the envelope 10, it is spaced from a top score line or fold line 28, about which the seal flap 18 folds in its closed position. The placement of the adhesive assembly 22 with respect to the flap edge portion 30 is critical, although the exact distance of the adhesive assembly 22 from the top score 28 is not critical. As will be discussed in more detail below, the adhesive assembly 22 must be positioned so as to only partially receive the flap edge portion 30 when the seal flap 18 is in the closed position.

The adhesive assembly 22 further includes a first portion 32 which is adapted to receive the flap edge portion 30 when the seal flap 18 is in its closed position, and a second portion 34 which is adapted to remain exposed when the seal flap 18 is in its closed position. The first portion 32 is shown with the phantom lines in FIG. 1 which are within the adhesive assembly 22. The relative sizes of the first portion 32 and the second portion 34 are not critical, although both portions must be capable of performing their respective sealing and adhesive functions, as are set forth in more detail below.

Figure 3:
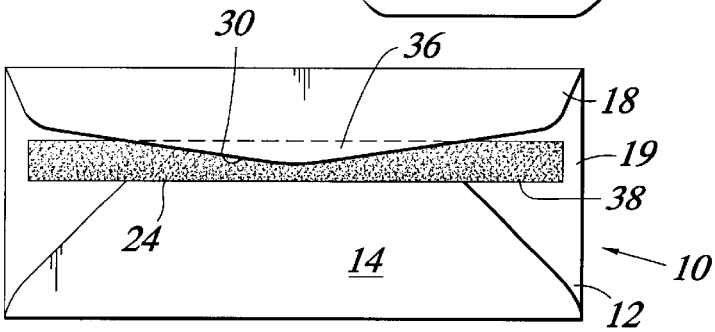
FIG. 3 is a back plan view of the self-sealing envelope of FIG. 1, with the protective layer of the adhesive assembly removed, and with the seal flap in its closed, sealed position.

As depicted in FIGS. 1 and 3, the adhesive assembly 22 is shown as being an elongated strip. However, it is understood that the adhesive assembly 22 can be any shape, including square, as depicted in FIG. 5, round, or novelty-shaped, as long as it remains possible for the adhesive assembly 22 to perform the dual adhesive functions as are described herein.

Turning now to FIG. 3, the envelope 10 is shown with the seal flap 18 in its closed position. As can be seen, the adhesive 24 also comprises a corresponding first adhesive portion 36 (shown in phantom lines as being positioned under the closed seal flap 18) and a second adhesive portion 38. The first adhesive portion 36 is adapted to adhesively receive and retain the flap edge portion 30 when the seal flap 18 is in its closed position, while the second adhesive portion 38 remains exposed and is adapted to be adhesively retained on a surface, such as a package, another envelope, or other suitable surface.

FIG. 5 shows an alternative embodiment of the envelope 10 of the present invention, this embodiment depicting an alternative type of envelope, as well as an alternatively shaped adhesive assembly 22. As can be seen, the present invention is not limited to any particular size, shape or type of envelope 10, nor is it limited to any particular size or shape of adhesive assembly 22. All that is necessary in accordance with the present invention is that, when the seal flap 18 of the envelope 10 is in its closed position, the adhesive assembly 22 must be positioned so that it is only partially covered by the closed seal flap 18 in an amount sufficient to adhesively engage and retain the seal flap 18, with the remaining portion of the adhesive assembly 22 remaining exposed in an amount sufficient to allow the envelope 10 to become adhesively affixed to another surface, such as a package, other envelope, or the like.

In manufacturing the adhesive assembly 22 of envelope 10, the protective strip 26 is positioned over the adhesive 24, and remains so positioned when the envelope is packaged and shipped to prevent the envelope 10 from adhering to adjacent envelopes or other undesired surfaces. As long as the adhesive assembly 22 is intact, the envelope 10 can be shipped with the seal flap 18 either in an open or a closed but unsealed position. In the alternative embodiment discussed above, wherein the adhesive assembly 22 comprises a remoistenable adhesive, there is no need for a protective strip, as such a remoistenable adhesive does not become tacky until it is activated by moistening.

In use, when a user is ready to seal the envelope 10 of FIG. 1 (typically after having placed the envelope contents, such as a greeting card, paper, packing list or other similar item, in the pouch 12 thereof), the user leaves the seal flap 18 in the open position and removes the protective strip 26, thereby exposing the underlying adhesive 24. In the alternative embodiment, the user activates the adhesive properties of the remoistenable adhesive by applying moisture to the same. The seal flap 18 is then folded about top score 28, with the seal flap 18 in its closed position overlying the first portion of adhesive 36 with flap edge portion 30. The second portion of adhesive 38 remains exposed, and the user can then use this second adhesive portion 38 to adhere the envelope 10 to another surface, such as a package or the like. In this manner, the envelope 10 of the present invention functions not only to be self-sealing, but also functions to be self-adhering to a surface, such as a package or the like, enabling the user to adhere the envelope 10 to such a surface without the need to utilize a separate adhesive means, such as tape, glue or other adhesive, as is otherwise typically necessary to retain an envelope on a package or other surface.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An envelope having means for sealing itself, said envelope comprising:

a pouch defined by front and rear panels, the pouch including an opening;

a seal flap extending from the front panel, the seal flap being foldable about a fold line from an open position in which the opening is accessible and the back panel is uncovered to a closed position in which the seal flap blocks the opening and overlies a portion of the back panel; and a length of an adhesive assembly situated on the back panel and including a corresponding length of an adhesive, the adhesive assembly being positioned so that when the seal flap is in the closed position, the seal flap covers a first portion of the adhesive assembly, with a second portion of the adhesive assembly remaining exposed;

wherein a first portion of the adhesive receives and seals the seal flap in the closed position, and a second portion of the adhesive remains exposed when the seal flap is in the closed position, the second portion of the adhesive being capable of adhering the envelope to another surface.

2. The envelope set forth in claim 1, wherein the adhesive comprises a pressure sensitive adhesive tape.

3. The envelope as set forth in claim 2, wherein the adhesive assembly further comprises a length of a removable protective strip selectively positioned over the adhesive, the adhesive being exposed upon removal of the protective strip.

4. The envelope as set forth in claim 3, wherein the adhesive has a defined perimeter, and the removable protective strip extends beyond at least a portion of the perimeter of the adhesive.

5. The envelope as set forth in claim 1, wherein the adhesive of the adhesive assembly comprises a remoistenable glue strip.

6. The envelope as set forth in claim 1, wherein the adhesive assembly is generally rectangular in shape.

7. The envelope as set forth in claim 1, wherein the adhesive assembly is generally square in shape.

* * * * *